US008342531B2

(12) United States Patent
Ko

(10) Patent No.: US 8,342,531 B2
(45) Date of Patent: Jan. 1, 2013

(54) BLACKJACK OPTIONS

(75) Inventor: Shenli Ko, Las Vegas, NV (US)

(73) Assignee: Betwiser Games, LLC, Las Vegas, NV (US)

( * ) Notice: Subject to any disclaimer, the term of this patent is extended or adjusted under 35 U.S.C. 154(b) by 330 days.

(21) Appl. No.: 12/592,587

(22) Filed: Nov. 30, 2009

(65) Prior Publication Data

US 2010/0133751 A1 Jun. 3, 2010

Related U.S. Application Data

(60) Provisional application No. 61/200,451, filed on Nov. 28, 2008.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,013,049 A * 5/1991 Tomaszewski ..... 273/292
5,255,915 A 10/1993 Miller
5,320,356 A * 6/1994 Cauda ..... 273/292
5,332,228 A * 7/1994 Schultz ..... 463/13
5,337,973 A 8/1994 Matsumoto et al.
5,377,994 A 1/1995 Jones
5,470,711 A * 11/1995 Bean et al. ..... 435/7.1
5,695,189 A * 12/1997 Breeding et al. ..... 273/149 R
5,897,436 A 4/1999 Singer et al.
5,979,897 A 11/1999 Grossman
6,139,014 A * 10/2000 Breeding et al. ..... 273/149 R
6,229,534 B1 5/2001 Gerra et al.
6,254,096 B1 * 7/2001 Grauzer et al. ..... 273/149 R
6,454,266 B1 * 9/2002 Breeding et al. ..... 273/292
6,588,750 B1 * 7/2003 Grauzer et al. ..... 273/149 R
6,604,741 B1 8/2003 Snow
6,607,443 B1 8/2003 Miyamoto et al.
6,869,075 B1 * 3/2005 Stavinsky ..... 273/292
6,923,446 B2 * 8/2005 Snow ..... 273/292
7,329,178 B1 * 2/2008 Moore et al. ..... 463/12
7,338,044 B2 * 3/2008 Grauzer et al. ..... 273/149 R
7,367,563 B2 * 5/2008 Yoseloff et al. ..... 273/292
7,384,045 B1 6/2008 David
7,510,190 B2 * 3/2009 Snow et al. ..... 273/292
7,584,962 B2 * 9/2009 Breeding et al. ..... 273/149 R
2002/0132660 A1 * 9/2002 Taylor ..... 463/16
2005/0269781 A1 * 12/2005 Sorge ..... 273/292
2006/0258436 A1 * 11/2006 McBride ..... 463/20
2009/0152815 A1 * 6/2009 Caniano ..... 273/292
2010/0317421 A1 * 12/2010 Kirkutis ..... 463/12

OTHER PUBLICATIONS

U.S. Appl. No. 09/179,748, filed Oct. 28, 1998, Miyamoto, et al.
U.S. Appl. No. 10/764,827, filed Jan. 26, 2004, Smith, et al.
U.S. Appl. No. 10/764,994, filed Jan. 26, 2004, Smith, et al.
U.S. Appl. No. 10/764,995, filed Jan. 26, 2004, Smith ,et al.

* cited by examiner

*Primary Examiner* — Alvin Hunter
*Assistant Examiner* — Dolores Collins
(74) *Attorney, Agent, or Firm* — Mark A. Litman & Associates, P.A.

(57) ABSTRACT

A method for conducting blackjack-style wagering games includes favorable player options to enhance its appeal. The player elects to undo a pair of initial cards in a two-card blackjack hand split to increase his chance of winning his hand.

9 Claims, No Drawings

BLACKJACK OPTIONS

CROSS REFERENCE TO RELATED APPLICATIONS

This application claims the benefit of U.S. Provisional Patent Application No. 61/200,451, filed on Nov. 28, 2008.

BACKGROUND OF THE INVENTION

The present invention relates to blackjack-style wagering games. More particularly, the present invention includes methods for playing blackjack-style games which enhance its appeal by providing more options in favor of the player.

Blackjack is generally conducted using one or more decks of fifty-two cards each. Each player makes a wager to receive two cards. A dealer also receives two cards, one of which is exposed. Each player forms a final player hand by opting to stand, hit (draw more cards), double down with an additional wager, or split the pair if the two cards are of the same rank. If the player doubles down, he has to put up an additional wager equal to his initial wager and then the dealer will deal him only one card. If the player hits and busts (i.e., the sum of the cards in his hand goes over a target value of 21), then the player loses his wager immediately. If the player splits a pair, he must put up an additional wager equal to his initial wager and split the pair into two hands. Where the house rules allow for double down after split, the player may double down after splitting a pair by putting up a double down wager next to the wager on the hand being doubled. Where the house rules allow for surrender, the player may surrender his hand and forfeit half the wager.

After each player has formed a final player hand or busted, a final dealer hand is formed. If the initial dealer hand is not 17 or greater, additional cards are drawn to the dealer hand until his hand is 17 or greater. If the dealer busts (i.e. has a hand value greater than 21), all players who did not already bust are rewarded. Otherwise, the numerical value of each player hand is compared to the numerical value of the dealer hand. In determining a numerical hand value, aces count one or eleven, face cards count ten, and all other cards count their face value. For each comparison, whoever has a hand closer to 21 wins. If the dealer hand and the player hand are equal, the player's wager is returned.

A blackjack variant known as Super Fun 21 is disclosed in U.S. Pat. No. 5,979,897. Super Fun 21, dealt with standard decks of 52 cards, provides not only the same double down options as Spanish 21 but also the option of surrendering half the bet on any hand including after splitting.

Another blackjack variant is disclosed in U.S. Pat. No. 6,604,741 entitled "Split card feature during continued play of blackjack." If a last additional card dealt matches a value of any previously dealt card, the player is allowed to separate the last additional card into a second hand. For example, a single card may be split off by the player after taking a hit when the hit card matches an earlier dealt card, such as one or the other of the two first cards in the original hand or another hit card.

Another blackjack variant is disclosed in U.S. Pat. No. 7,384,045. A "double down split" option is provided so that the player who wishes to double down can put up an additional wager for an additional hand that shares the original two cards dealt to him. For example, a player who receives 9-2 in his original two cards may elect to "split double" and create a second hand by matching his initial wager. Now the two hands will share the 9-2 as their starting hand but will receive their own double down card respectively.

Another blackjack variant is disclosed in U.S. Pat. No. 7,329,178 entitled "Blackjack game with discard option." The player is allowed the option to discard one of his initial two cards by paying a discard fee in hopes of drawing a new card that can improve his hand.

The above prior art inventions provide blackjack players with options that either enable them to make more lucrative bets or mitigate possible frustrations. The invention also provides the casino operators more rule options in favor of the player to make their game more appealing. The rule options are described below:

SUMMARY OF THE INVENTION

An improved method for conducting a blackjack card game uses A) physical playing cards at each player position or B) a processor sending virtual images of playing cards to a display system at each player position. The blackjack card game is played between a dealer and at least one player at a physical gaming table according to the predetermined rules of blackjack card games utilizing playing cards where all face cards count ten, aces count one or eleven, and all other cards count their face value. Each player makes an initial wager and the dealer or a virtual dealer randomly distributes an initial player hand of two cards to each player and at least one card to the dealer. The improved method is such that when a player splits a pair of equal count cards and places an additional wager, the player exercises at least one of the following options before the dealer hand is revealed, completed and compared to the player hand to determine the outcome:

a) split undo, wherein when the player takes a first hit with the first card in the split pair of equal count cards, the player exercises an option of one step selected from the group consisting of:

i) accepting the first hit card, and standing or taking additional hit cards after the first hit card; and ii) combining the count of the first hit card with the combined count of the pair of equal count cards and forming a single blackjack hand; and b) split and share, wherein when the player takes a first hit with the first card in the split pair of equal count cards, the player exercises an option of one step selected from the group consisting of:

i) keeping the first hit card with the first card of the split equal count cards as a first of two hands, and ii) using the first hit card as a count card with both the first card of the split equal count cards and the second card of the split equal count cards.

DETAILED DESCRIPTION OF THE INVENTION

These specific play steps and techniques are within the generic description provided in the Summary of the Invention.

Pair Split Undo

In conventional blackjack if a player receives a pair in his initial hand, by making an additional wager equal to the initial wager he has the option of splitting the pair into two separate hands and using each card as a basis for a separate hand. Each of those individual hands is then played out separately.

The invention allows the player the option to undo a pair split to his advantage. After splitting a pair into two hands and drawing a new card for the first split hand, if the player wants to undo the split and combine the original pair with the new card into one hand, he has the option to do so. The dealer will put the player's original pair and the new card together as one hand. For example, suppose a player draws a 5 for his first split hand after splitting a pair of 8's. He now can undo the pair split and play the three cards as one hand, as the three cards now total a perfect 21 (8+8+5).

In one embodiment, the player is allowed to draw additional cards after undoing a pair split. In another embodiment, the player is disallowed to draw additional cards after undoing a pair split. In yet another embodiment, the additional wager the player made when splitting the pair is returned if he elects to undo the pair split. In yet another embodiment the additional wager the player made when splitting the pair is collected if he elects to undo the pair split. In yet another embodiment, the player is allowed to combine the additional wager with the initial wager after undoing a pair split. In yet another embodiment, if the player's additional wager remains in action after the split undo, the player's additional wager can be collected, returned or rewarded as follows depending on whether his hand beats the dealer hand:

1. The additional wager and the initial wager are collected by the dealer, if the dealer hand beats the player hand.
2. The additional wager is returned and the initial wager rewarded, if the player hand beats the dealer hand.
3. The additional wager and the initial wager are rewarded, if the player hand beats the dealer hand.

Split and Share

Blackjack players who have split a pair are allowed the option to share the first card drawn between the two split hands. For example, a player who has split a pair of 3's and drawn a first card of 8 to the 3 in the first hand can opt to let the second hand also share the 8 as its second card. Through sharing the 8 between the two hands of 3, each hand now has a total of 11, which is a very lucrative two-card starting hand that usually calls for a double down.

Also, split and share can be applied to any first two cards. The player will be allowed to split any of his first two cards into two hands and share the first card drawn between the two new hands. For example, the player is dealt a 3-5 and draws a 6. At his point he can split the 3 and 5 into two starting hands and let the two hands share the 6. Now one hand has 9 and one hand has 11. He must put up an equal bet for the second hand.

Discard Rescue

If the first card a player draws results in the player hand totaling a "stiff," e.g., 14 through 16, then the player has the option of discarding one of the three cards in his hand. The player can continue to draw after the discarding. For example, the player receives an initial two card hand consisting of a 5 and a 7. The player draws a card of 3, which results in the player hand totaling a poor 15. Now the player has the option to discard the 5 and keep the 7 and 3 for a total of 10, which is a much better starting hand.

It should be noted that the invention can be adapted to any blackjack-style games in which pair splitting and double down are allowed, such as Spanish 21, No Bust 21 and Super Fun 21.

The present invention may also include a device for carrying out a method according to an embodiment of the present invention. The device could take any form, including a general use computer, such as a PC, a specific use computer, such as an electronic gaming machine, a hand held device or cellular telephone, or any other type of electronic device.

The present technology may be described in a number of alternative ways. One way is a description as an improved method for conducting a blackjack card game using A) physical playing cards at each player position or B) a processor sending virtual images of playing cards to a display system at each player position. The blackjack card game is played between a dealer (real or virtual) and at least one live player at a physical gaming table according to the predetermined rules of blackjack card games. A blackjack card game uses playing cards where all face cards count ten, aces count one or eleven, and all other cards count their face value. Each player makes an initial wager and the dealer or a virtual dealer (by way of a processor containing game rules and playing card image content and a random number generator or access to randomly arranged sets or deck(s) of playing card data) randomly distributes an initial player hand of two cards to each player and at least one card to the dealer. An improved method has the player exercising at least one of the following options before the dealer hand is revealed, completed and compared to the player hand to determine the outcome:

a) split undo, wherein when a player splits a pair of equal count cards and takes a first hit with the first card in the split pair of equal count cards, the player exercises an option of one step selected from the group consisting of:

i) accepting the first hit card, and standing or taking additional hit cards after the first hit card; and ii) combining the count of the first hit card with the combined count of the pair of equal count cards and forming a single blackjack hand; and b) split and share, wherein when a player splits a pair of equal count cards and takes a first hit with the first card in the split pair of equal count cards, the player exercises an option of one step selected from the group consisting of:

i) keeping the first hit card with the first card of the split equal count cards as a first of two hands, and ii) using the first hit card as a count card with both the first card of the split equal count cards and the second card of the split equal count cards.

In the first described method, a player may execute the split undo option. The player who has split a pair of equal count cards has made an additional wager equal to the initial wager, and after one hit card is dealt to the first split hand, the player combines the one hit card with the original equal count pair into a single hand. One of the initial wager and the additional wager may be returned to said player when the split undo option is exercised. One of the initial wager and the additional wager may be collected when the split undo option is exercised. Both the additional wager and the initial wager may remain in action if the split undo option is exercised. The player may elect to draw more cards in the single hand after undoing a pair split. Any wagers remaining at risk action after the split undo option is exercised are resolved in steps selected from the group consisting of a) collected if the dealer hand beats the player hand, b) resolved in favor of the player if the player hand beats the dealer hand, and c) rewarded at a rate of less than 1 to 1 if the player hand beats the dealer hand. When step a) (split card undo) is practiced, either the initial wager or the additional wager in the split undo option may be returned to the player.

When the player performs the steps of the split and share option, the player 1) may split said two equal count cards into two starting hands, 2) may place an additional wager for the additional starting hand that is equal to the initial wager, and 3) after one new card is dealt to the first starting hand, may share the new card between the two starting hands. The two cards need not be equal count cards, but preferably are equal count cards.

Another way of describing an improved method for conducting a blackjack card game according to the present technology is using A) physical playing cards at each player position or B) a processor sending virtual images of playing cards to a display system at each player position. The blackjack card game is played between a dealer (real or virtual) and at least one player at a physical gaming table according to the predetermined rules of blackjack card games utilizing playing cards where all face cards count ten, aces count one or eleven, and all other cards count their face value. Each player makes an initial wager and the dealer or virtual dealer (as explained above) randomly distributes an initial player hand of two cards to each player and at least one card to the dealer. The improved method comprises, before the dealer hand is revealed, completed and compared to the player hand to determine the outcome, the player exercising a discard rescue option wherein when a player with a single hand takes a first hit card to form a first hand or splits a pair of equal count cards or unequal count cards and takes a first hit with the first card in the split pair of cards to form a first hand and a count of the first hand equals exactly 12, 13, 14, 15 or 16, the player exercises an option of one step selected from the group consisting of:

i) keeping the first hand with a count of 12, 13, 14, 15 or 16 and playing that first hand; and ii) discarding any one of the three cards to leave a two card first hand and playing the two cards remaining in the first hand to conclusion of a hand of blackjack.

In playing the discard rescue option, the player may discard one of the three cards in his hand after that player draws a card which results in the numerical value of his hand matching a predetermined value. The predetermined value may range from 12 to 16, but may also include less than all of those values (e.g., only 14-16, only 13-16, only 12-15 and the like).

If played in an electronic of partially electronic format (e.g., with physical playing cards and electronic wagering), the table or electronic interaction among players and the house would require the use of essentially standard electronic interfaces and electronic gaming tables and networks, having player input/output interfaces, video screens, and combinations of processors, flash memory, RAM, EEPROM, storage, software, Random Number Generation, protocols among positions, security functions and the like, as needed to properly execute play of the game on the existing formats. The play of the game may be completed manually on a non-electronic game table, with the dealer using a physical deck(s) of cards, visually identifying the amounts and positions of wagers, manually collecting and paying out wagers, etc. It is possible to incorporate some degree or nearly an entire electronic system into the game table or into the play of the game. Such partial or complete electronic systems may perform such tasks as identifying the existence of a wager (e.g., U.S. Pat. Nos. 6,229,534; 5,337,973; and 5,377,994), or may provide virtual cards from an electronically stored deck of cards (e.g., U.S. Pat. Nos. 5,255,915; and 5,897,436). The games of the present invention could also be executed on a multiple player gaming platform including a simulated virtual dealer, such as the device and system described in U.S. patent application Ser. No. 09/179,748, filed Oct. 28, 1998, now U.S. Pat. No. 6,607,443 and U.S. patent application Ser. Nos. 10/764,995; 10/764,994; and 10/764,827, each filed on Jan. 26, 2004. The content of these and every patent specification and application specification is hereby and herein incorporated by reference.

Although the invention has been described in detail with reference to several embodiments, additional variations and modifications exist within the scope and spirit of the invention as described and defined in the following claims.

What is claimed:

1. An improved method for conducting a blackjack-style card game using a processor executing code to send virtual images of playing cards to a display system at each player position, the blackjack-style card game being played between a virtual dealer and at least one electronic player position at a physical gaming table according to the predetermined rules of blackjack card games utilizing virtual playing cards where all face cards count ten, aces count one or eleven, and all other cards count their face value, in which at each player position that receives an initial wager, the processor executes code such that the virtual dealer randomly distributes an initial player position hand of two virtual cards to each player position and at least one virtual card to the virtual dealer, the improved method comprising the processor recognizing when a player position splits a pair of equal count cards, the processor recognizes that the player position places an additional wager, and the processor executes code to provide a first hit card with the first card in the split pair of equal count cards, the processor recognizing the player position exercising a split undo option in which the player position combines the count of the first virtual hit card with the combined count of the pair of equal count virtual cards and forms a single virtual blackjack hand.

2. The method of claim 1, wherein one of the initial wager and the additional wager is returned to said player when the split undo option is exercised.

3. The method of claim 1, wherein one of the initial wager and the additional wager is collected when the split undo option is exercised.

4. The method of claim 1, wherein both the additional wager and the initial wager remain in action when the split undo option is exercised.

5. The method of claim 1, wherein the player position is provided with additional playing cards in the single hand after undoing a pair split.

6. The method of claim 1, wherein the additional wager remains at risk action after the split undo option is exercised, it is resolved in steps selected from the group consisting of a) collecting the additional wager and the initial wager if the dealer hand beats the player position hand, b) rewarding at least one of the additional wager and the initial wager if the player position hand beats the dealer hand, and c) rewarding at least one of the additional wager and the initial wager at a rate of less than 1 to 1 if the player position hand beats the dealer hand.

7. An improved method for conducting a blackjack-style card game using a processor executing code sending virtual images of playing cards to a display system at each player position, the blackjack-style card game being played between a virtual dealer and at least one player position at a physical gaming table according to the predetermined rules of blackjack card games utilizing virtual playing cards where all face cards count ten, aces count one or eleven, and all other cards count their face value, in which at each player where the processor recognizes an initial wager and the virtual dealer distributes an initial player hand of two random virtual cards to each player position and at least one virtual card to the dealer, the improved method further comprising before the virtual dealer hand is revealed, completed and compared to the player position hand to determine the outcome, the processor recognizes when the player position exercises a discard rescue option wherein when a player position with a single hand takes a first virtual hit card to form a first hand or splits a pair of equal count virtual cards or unequal count virtual cards and takes a first hit with the first virtual card in the split pair of virtual cards to form a first hand and a count of the first hand equals a predetermined value, the player exercises an option of discarding any one of the three cards to leave a two card first hand and playing the two cards remaining in the first hand to conclusion of a hand of blackjack.

8. The method of claim 7, wherein said predetermined value ranges from 12 to 16, but includes less than all of those values of 12, 13, 14, 15 and 16.

9. An apparatus for playing a blackjack wagering game comprising:

a processor;

a random number generator;

multiple player positions each having a display system;

a video display in data communication with the processor; wherein the processor executes software enabling play a method wherein a processor sends virtual images of playing cards to the a display system at each player position, the blackjack-style card game being played between a virtual dealer and at least one player position at a virtual gaming table according to the predetermined rules of blackjack card games utilizing virtual playing cards where all face cards count ten, aces count one or eleven, and all other cards count their face value, in which each player position has an initial wager recognized by the processor and the virtual dealer randomly distributes an initial player hand of two cards to each player position at which the initial wager has been recognized by the processor and at least one card to the virtual dealer, the improved method comprising if a player position splits a pair of equal count cards, has an additional wager recognized by the processor, and takes a first hit card with the first card in the split pair of equal count cards, the processor recognizes and accepts a player split undo option in which the player position exercises an option of one step selected from the group consisting of:

i) combining the count of the first hit card with the combined count of the pair of equal count cards and forming a single blackjack hand;

with virtual images of playing cards displayed on the video display after selection with the random number generator, the processor determining game outcomes according to rules stored in memory accessed by the processor.

* * * * *